US010235985B2

(12) United States Patent
Christoph et al.

(10) Patent No.: US 10,235,985 B2
(45) Date of Patent: Mar. 19, 2019

(54) EXTERNALLY COUPLED LOUDSPEAKER SYSTEM FOR A VEHICLE

(71) Applicant: HARMAN BECKER AUTOMOTIVE SYSTEMS GMBH, Karlsbad (DE)

(72) Inventors: Markus Christoph, Straubing (DE); Andreas Pfeffer, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 102 days.

(21) Appl. No.: 15/389,561

(22) Filed: Dec. 23, 2016

(65) Prior Publication Data

US 2017/0186416 A1 Jun. 29, 2017

(30) Foreign Application Priority Data

Dec. 23, 2015 (EP) ..... 15202357

(51) Int. Cl.

| | |
|---|---|
| ***G10K 11/16*** | (2006.01) |
| ***G10K 11/178*** | (2006.01) |
| ***G10K 11/162*** | (2006.01) |
| ***H04R 3/00*** | (2006.01) |
| *H04R 1/02* | (2006.01) |

(52) U.S. Cl.

CPC ..... *G10K 11/178* (2013.01); *G10K 11/162* (2013.01); *G10K 11/17875* (2018.01); *H04R 3/00* (2013.01); *G10K 2210/1282* (2013.01); *G10K 2210/3026* (2013.01); *G10K 2210/509* (2013.01); *H04R 1/025* (2013.01); *H04R 2499/13* (2013.01)

(58) Field of Classification Search

CPC H04R 1/1083; H04R 2499/13; G10K 11/178; G10K 11/162; G10K 11/1782; G10K 11/1788; G10K 2210/1282

USPC ..... 381/71.1, 71.4

See application file for complete search history.

(56) References Cited

U.S. PATENT DOCUMENTS

2002/0129990 A1* 9/2002 Vanderveen ..... G10K 11/1788 181/206
2010/0028134 A1* 2/2010 Slapak ..... F24F 13/24 415/119
2010/0329477 A1* 12/2010 Park ..... G10K 15/02 381/86

FOREIGN PATENT DOCUMENTS

| | | |
|---|---|---|
| EP | 1493627 A1 | 1/2005 |
| EP | 2629289 A1 | 8/2013 |
| WO | 9417513 A1 | 8/1994 |

OTHER PUBLICATIONS

Extended European Search Report for Application No. 15202357.8, dated Jul. 19, 2016, 7 pages.

* cited by examiner

*Primary Examiner* — Katherine A Faley
(74) *Attorney, Agent, or Firm* — Brooks Kushman P.C.

(57) ABSTRACT

A loudspeaker system is provided that includes a loudspeaker that is arranged in a baffle between a passenger compartment of a vehicle and the outside of the passenger compartment. The loudspeaker is configured to radiate an acoustical signal to the passenger compartment. The loudspeaker system further includes active noise control system wherein a microphone is acoustically coupled to the loudspeaker via a secondary path, and the loudspeaker is electrically coupled to the microphone via an active noise control filter.

16 Claims, 3 Drawing Sheets

EXTERNALLY COUPLED LOUDSPEAKER SYSTEM FOR A VEHICLE

CROSS-REFERENCE TO RELATED APPLICATIONS

This application claims priority to EP application Serial No. 15202357.8 filed Dec. 23, 2015, the disclosure of which is hereby incorporated in its entirety by reference herein.

TECHNICAL FIELD

The disclosure relates to an externally coupled loudspeaker system, in particular to an externally coupled loudspeaker system in a vehicle.

BACKGROUND

Automotive sound systems typically include several loudspeakers positioned in various locations within the passenger compartment of a vehicle. Typical loudspeaker positions include door panels or interior trim panels. Low frequency reproducing speakers, also known as woofers or subwoofers, are often located in the trunk, the rear panel shelf, the chassis or any frame elements of a vehicle. In this way an otherwise necessary loudspeaker housing may be omitted because the front and the back side of the loudspeaker are isolated from each other by the rear panel shelf or the chassis, respectively. This approach, therefore, allows for a very compact and weight efficient arrangement without sacrificing acoustical performance. Without a housing, however, the speaker components have to sustain extreme environmental conditions, which makes it necessary to protect the speaker, e.g. by means of a weather resistant membrane. Further, noise which would normally be blocked by the otherwise sealed passenger cabin may enter the vehicle which leads to a higher noise pollution.

SUMMARY

A loudspeaker system includes a loudspeaker that is arranged in a baffle between a passenger compartment of a vehicle and an outside of the passenger compartment. The loudspeaker is configured to radiate an acoustical signal to the passenger compartment. The loudspeaker system further includes an active noise control system and a microphone is acoustically coupled to the loudspeaker via a secondary path, and the loudspeaker is electrically coupled to the microphone via an active noise control filter.

A noise reducing sound reproduction method includes radiating an acoustical signal to the inside of a passenger compartment with a loudspeaker that is arranged in a baffle between the passenger compartment and an outside of the passenger compartment. The method further includes reducing a disturbing signal with an active noise control system including a microphone that is acoustically coupled to the loudspeaker via a secondary path. The loudspeaker is electrically coupled to the microphone via an active noise control filter.

Other systems, methods, features and advantages will be or will become apparent to one with skill in the art upon examination of the following detailed description and figures. It is intended that all such additional systems, methods, features and advantages included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
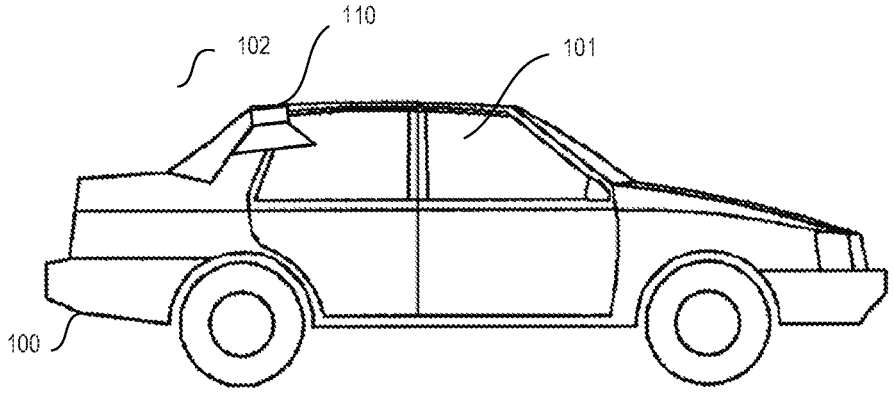
FIG. 1 is a schematic diagram illustrating a loudspeaker in a vehicle.

FIG. 1 illustrates a vehicle 100 with a loudspeaker 110. The loudspeaker 110 may be part of an automotive sound system. Automotive sound systems typically include several loudspeakers. Only one loudspeaker 110 is exemplarily illustrated in FIG. 1. A loudspeaker 110 may be positioned in different locations within the passenger compartment 101 of the vehicle 100. If a loudspeaker 110 is positioned in the chassis of the vehicle 100 between the passenger compartment 101 and the outside 102 of the vehicle 100, an otherwise necessary loudspeaker housing may be omitted. This, therefore, is very compact and weight efficient without sacrificing acoustical performance.

Without a housing, however, the speaker components (not illustrated in detail in FIG. 1) have to sustain extreme environmental conditions, which makes it necessary to protect the loudspeaker 110, for example with a weather resistant membrane. Another drawback that arises due to the direct coupling of the loudspeaker 110 to the outside 102 of the vehicle 100 is instantaneous air pressure differences between the inside 101 and the outside 102 of the vehicle, for example, when driving into a tunnel at high speed or when opening the sunroof at an elevated speed. This may impact the membrane rest position and/or displacement of the moving voice coil and thereby the overall performance of the loudspeaker 110. This again may lead to a dynamically changing operating point, which affects the acoustic performance of the loudspeaker 110, e.g., harmonic distortions. Further, noise which would usually be blocked by the otherwise sealed passenger cabin 101 may enter the passenger compartment (or cabin) 101 which leads to a higher noise pollution.

The loudspeaker 110, therefore, is coupled to a noise reduction system, i.e., a feedback active noise control (ANC) system. Feedback ANC systems are usually intended to reduce or even cancel a disturbing signal, such as noise, by providing at a listening site a noise reducing signal that ideally has the same amplitude over time but the opposite phase compared to the noise signal. By superimposing the noise signal and the noise reducing signal, the resulting signal, also known as an error signal, ideally tends toward zero. The quality of the noise reduction depends on the quality of a so-called secondary path, i.e., the acoustic path between a loudspeaker and a microphone representing the listener's ear. The quality of the noise reduction further depends on the quality of a so-called ANC filter that is connected between the microphone and the loudspeaker and that filters the error signal provided by the microphone such that, when the filtered error signal is reproduced by the loudspeaker, it further reduces the error signal. However, problems occur when additionally to the filtered error signal, a useful signal such as music or speech is provided at the listening site, in particular by the loudspeaker that also reproduces the filtered error signal. Then, the useful signal may be deteriorated by the system.

For the sake of simplicity, no distinction is made herein between electrical and acoustic signals. However, all signals provided by the loudspeaker or received by the microphone are actually of an acoustic nature. All other signals are electrical in nature. The loudspeaker and the microphone may be part of an acoustic sub-system (e.g., a loudspeaker-room-microphone system) having an input stage formed by the loudspeaker and an output stage formed by the microphone; the sub-system being supplied with an electrical input signal and providing an electrical output signal. "Path" means in this regard an electrical or acoustical connection that may include further elements such as signal conducting means, amplifiers, filters, etc. A spectrum shaping filter is a filter in which the spectra of the input and output signal are different over frequency.

Figure 2:
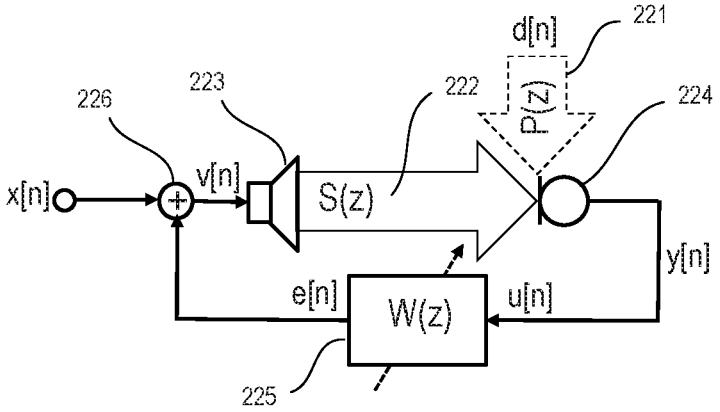
FIG. 2 is a block diagram of a general feedback type active noise reduction system in which the useful signal is supplied to the loudspeaker signal path.

Reference is now made to FIG. 2, which is a block diagram illustrating a general feedback type active noise reduction (ANC) system in which a disturbing signal d[n], also referred to as noise signal, is transferred (radiated) to a listening site, for example, a listener's ear, via a primary path 221. The primary path 221 has a transfer characteristic of P(z). Additionally, an input signal v[n] is transferred (radiated) from a loudspeaker 223 to the listening site via a secondary path 222. The secondary path 222 has a transfer characteristic of S(z).

A microphone 224 positioned at the listening site receives together with the disturbing signal d[n], filtered by the primary path P(z), the signals that arise from the loudspeaker 223, filtered by the secondary path S(z). The microphone 224 provides a microphone output signal y[n] that represents the sum of these received signals. The microphone output signal y[n] is supplied as filter input signal u[n] to an ANC filter 225 that outputs to an adder 226 an error signal e[n]. The ANC filter 225, which may be an adaptive or static filter, has a transfer characteristic of W(z). The adder 226 also receives an optionally pre-filtered, e.g., with a spectrum shaping filter (not shown in the drawings) useful signal x[n] such as music or speech and provides an input signal v[n] to the loudspeaker 223.

The signals x[n], y[n], e[n], u[n] and v[n] are in the discrete time domain. For the following considerations their spectral representations X(z), Y(z), E(z), U(z) and V(z) are used. The differential equations describing the system illustrated in FIG. 2 are as follows:

$$Y(z)=S(z)\cdot V(z)=S(z)\cdot(E(z)+X(z)) \tag{1}$$

$$E(z)=W(z)\cdot U(z)=W(z)\cdot Y(z) \tag{2}$$

In the system of FIG. 2, the useful signal transfer characteristic M(z)=Y(z)/X(z) is thus $$M(z)=S(z)/(1-W(z)\cdot S(z)) \tag{3}$$

Assuming W(z)=1 then $$lim[S(z)\rightarrow 1]M(z)M(z) \Longrightarrow M(Z)\rightarrow\infty \tag{4}$$

$$lim[S(z)\rightarrow\pm\infty]M(z) \Longrightarrow M(z)\rightarrow 1 \text{ or } -1 \tag{5}$$

$$lim[S(z)\rightarrow 0]M(z) \Longrightarrow S(z) \text{ or } 0 \tag{6}$$

Assuming W(z)=∞ then $$lim[S(z)\rightarrow 1]M(z) \Longrightarrow M(z)\rightarrow 0. \tag{7}$$

As can be seen from equations (4)-(7), the useful signal transfer characteristic M(z) approaches 0 when the transfer characteristic W(z) of the ANC filter 225 increases, while the secondary path transfer function S(z) remains neutral, i.e., at levels around 1, i.e., 0[dB]. For this reason, the useful signal x[n] has to be adapted accordingly to ensure that the useful signal x[n] is apprehended identically by a listener when ANC is on or off. Furthermore, the useful signal transfer characteristic M(z) also depends on the transfer characteristic S(z) of the secondary path 222 to the effect that the adaption of the useful signal x[n] also depends on the transfer characteristic S(z) and its fluctuations due to aging, temperature, change of listener etc. so that a certain difference between "on" and "off" will be apparent.

Figure 3:
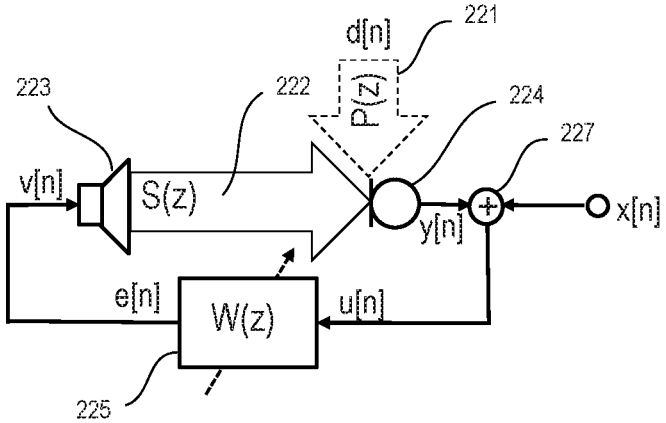
FIG. 3 is a block diagram of a general feedback type active noise reduction system in which the useful signal is supplied to the microphone signal path.

While in the system of FIG. 2 the useful signal x[n] is supplied to the acoustic sub-system (loudspeaker, room, microphone) at the adder 226 connected upstream of the loudspeaker 223, in the system of FIG. 3 the useful signal x[n] is supplied at the microphone 224. Therefore, in the system of FIG. 3, the adder 226 is omitted and an adder 227 is arranged downstream of microphone 224 to sum up the, e.g., pre-filtered, useful signal x[n] and the microphone output signal y[n]. Accordingly, the loudspeaker input signal v[n] is the error signal [e], i.e., v[n]=[e], and the filter input signal u[n] is the sum of the useful signal x[n] and the microphone output signal y[n], i.e., u[n]=x[n]+y[n].

The differential equations describing the system illustrated in FIG. 3 are as follows:

$$Y(z)=S(z)\cdot V(z)=S(z)\cdot E(z) \tag{8}$$

$$E(z)=W(z)\cdot U(z)=W(z)\cdot(X(z)+Y(z)) \tag{9}$$

The useful signal transfer characteristic M(z) in the system of FIG. 3 without considering the disturbing signal d[n] is thus:

$$M(z)=(W(z)\cdot S(z))/(1-W(z)\cdot S(z)) \tag{10}$$

$$lim[(W(z)\cdot S(z))\rightarrow 1]M(z) \Longrightarrow M(z)\rightarrow\infty \tag{11}$$

$$lim[(W(z)\cdot S(z))\rightarrow 0]M(z) \Longrightarrow M(z)\rightarrow 0 \tag{12}$$

$$lim[(W(z)\cdot S(z))\rightarrow\pm\infty]M(z) \Longrightarrow M(z)\rightarrow 1 \text{ or } -1. \tag{13}$$

As can be seen from equations (11)-(13), the useful signal transfer characteristic M(z) approaches 1 or −1 when the open loop transfer characteristic (W(z)·S(z)) increases or decreases and approaches 0 when the open loop transfer characteristic (W(z)·S(z)) approaches 0. For this reason, the useful signal x[n] has to be adapted additionally in higher spectral ranges to ensure that the useful signal x[n] is apprehended identically by a listener when ANC is on or off. Compensation in higher spectral ranges is, however, quite difficult so that a certain difference between "on" and "off" will be apparent. On the other hand, the useful signal transfer characteristic M(z) does not depend on the transfer characteristic S(z) of the secondary path 222 and its fluctuations due to aging, temperature, change of listener etc.

Figure 4:
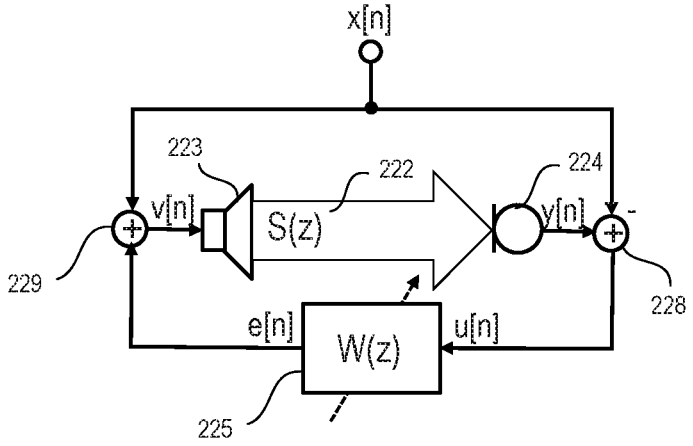
FIG. 4 is a block diagram of a general feedback type active noise reduction system in which the useful signal is supplied to the loudspeaker and microphone signal paths.

FIG. 4 is a block diagram illustrating a general feedback type active noise reduction system in which the useful signal is supplied to both, the loudspeaker path and the microphone path. For the sake of simplicity, the primary path 221 is omitted below notwithstanding that noise (disturbing signal d[n]) is still present. In particular, the system of FIG. 4 is based on the system of FIG. 2, however, with an additional subtractor 228 that subtracts the useful signal x[n] from the microphone output signal y[n] to form the ANC filter input signal u[n] and with an adder 229 that adds the useful signal x[n] to error signal e[n].

The differential equations describing the system illustrated in FIG. 4 are as follows:

$$Y(z)=S(z)\cdot V(z)=S(z)\cdot(E(z)+X(z)) \tag{14}$$

$$E(z)=W(z)\cdot U(z)=W(z)\cdot(Y(z)-X(z)) \tag{15}$$

The useful signal transfer characteristic M(z) in the system of FIG. 4 is thus $$M(z)=(S(z)-W(z)\cdot S(z))/(1-W(z)\cdot S(z)) \tag{16}$$

$$lim[(W(z)\cdot S(z))\rightarrow 1]M(z) \Longrightarrow M(z)\rightarrow\infty \tag{17}$$

$$lim[(W(z)\cdot S(z))\rightarrow 0]M(z) \Longrightarrow M(z)\rightarrow S(z) \tag{18}$$

$$lim[(W(z)\cdot S(z))\rightarrow\pm\infty]M(z) \Longrightarrow M(z)\rightarrow 1. \tag{19}$$

It can be seen from equations (17)-(19) that the behavior of the system of FIG. 4 is similar to that of the system of FIG. 3. The only difference is that the useful signal transfer characteristic M(z) approaches S(z) when the open loop transfer characteristic (W(z)·S(z)) approaches 0. Like the system of FIG. 2, the system of FIG. 4 depends on the transfer characteristic S(z) of the secondary path 222 and its fluctuations due to aging, temperature, change of listener etc.

Figure 5:
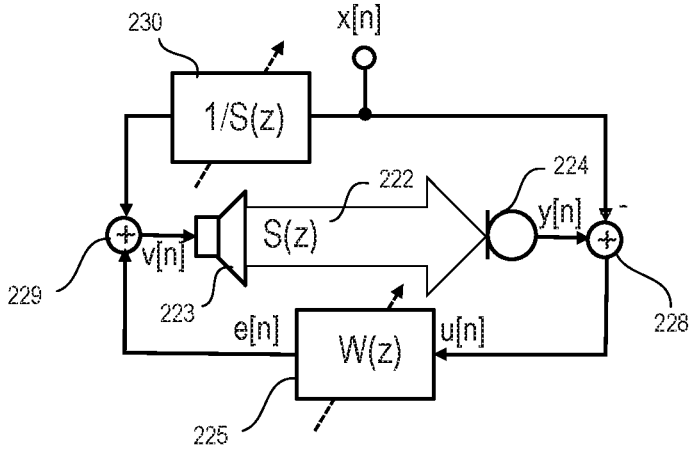
FIG. 5 is a block diagram of the active noise reduction system of FIG. 4, in which the useful signal is supplied via a spectrum shaping filter to the loudspeaker path.

In FIG. 5, a system is shown that is based on the system of FIG. 4 and that additionally includes an equalizing filter 230 connected upstream of the adder 229 in order to filter the useful signal x[n] with the inverse secondary path transfer function 1/S(z). The differential equations describing the system illustrated in FIG. 5 are as follows:

$$Y(z)=S(z)\cdot V(z)=S(z)\cdot(E(z)+X(z)/S(z)) \tag{20}$$

$$E(z)=W(z)\cdot U(z)=W(z)\cdot(Y(z)-X(z)) \tag{21}$$

The useful signal transfer characteristic M(z) in the system of FIG. 5 is thus $$M(z)=Y(z)/X(z)=(1-W(z)\cdot S(z))/(1-W(z)\cdot S(z))=1 \tag{22}$$

As can be seen from equation (22), the microphone output signal y[n] is identical to the useful signal x[n], which means that signal x[n] is not altered by the system if the equalizer filter is exact the inverse of the secondary path transfer characteristic S(z). The equalizer filter 230 may be a minimum-phase filter for optimum results, i.e., optimum approximation of its actual transfer characteristic to the inverse of, the ideally minimum phase, secondary path transfer characteristic S(z) and, thus y[n]=x[n]. This configuration acts as an ideal linearizer, i.e., it compensates for any deteriorations of the useful signal due to its transfer from the loudspeaker 223 to the microphone 224 representing the listener's ear. It hence compensates for, or linearizes the disturbing influence of the secondary path S(z) to the useful signal x[n], such that the useful signal arrives at the listener as provided by the source, without any negative effect due to acoustical properties of the headphone, i.e., y[z]=x[z]. As such, with the help of such a linearizing filter it is possible to make a poorly designed acoustical system sound like an acoustically perfectly adjusted, i.e., linear one.

The system illustrated in FIG. 5 shows how a desired signal such as music, for example, can be fed into an ANC circuit, in particular a feedback ANC circuit. This circuit is able to eliminate noise without causing an unmotivated damping of the desired signal. It further offers a solution to automatically compensate for dynamical, externally driven modifications of the operation point of the loudspeaker. Such modifications could be caused by changes of the outside sound pressure, for example, as has already been explained before. Furthermore, even a driver-intrinsic nonlinearity which evokes harmonic distortions can be compensated and the final acoustic performance of the system may be optimized without any constraints concerning additional equalizing etc.

However, active noise control systems are generally only able to handle low spectral components of the noise. To reduce the upper spectral contribution of the noise, other systems may be implemented. Such systems may be passive noise reduction systems. For example, insulation wool may be arranged adjacent to the membrane of the loudspeaker. The insulation wool may be arranged in front of the membrane, for example, covering the front side of the loudspeaker. It may also be arranged behind the membrane, both in front and behind the membrane or it may be integrated in the membrane, for example. The use of insulation wool, however, is only an example. Any other passive noise reduction system may be implemented as well which is suitable to reduce the upper spectral contribution of the noise such as a Helmholtz resonator, for example.

Figure 6:
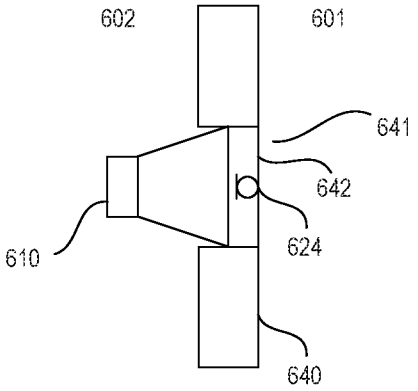
FIG. 6 is a schematic diagram illustrating an externally coupled loudspeaker system with microphone.

Referring to FIG. 6, a loudspeaker arrangement is schematically illustrated which includes both an active and a passive noise reduction system. The loudspeaker 610 is arranged in a baffle 640 between the inside 601 and the outside 602 of a passenger compartment of a vehicle. The baffle 640 may include an opening 641 in which the loudspeaker 610 is arranged. A first side of the loudspeaker 610 may be directed to the inside 601 and a second side of the loudspeaker 610 may be directed to the outside 602 so that an acoustical signal is radiated to the inside 601 of the passenger compartment. The membrane or diaphragm of the loudspeaker 610 may be positioned at the first side of the loudspeaker 610 or at the second side of the loudspeaker 610.

The loudspeaker 610 may be arranged in such a way that there is no or substantially no acoustic pressure isolation between the baffle 640 and the loudspeaker 610. A microphone 624 may be arranged at one side of the loudspeaker 610 on the inside 601 of the passenger compartment. The microphone 624 may be held in its position by any suitable holding device (not illustrated in FIG. 6). It is also possible that the microphone is arranged inside the loudspeaker 610, between the first side and the second side of the loudspeaker 610. The microphone 624 may be part of an active noise control system (i.e., error microphone), as described above in connection with FIGS. 2 to 5. The microphone 624, therefore, is acoustically coupled to the loudspeaker 610 via a secondary path. An ANC filter (not illustrated in FIG. 6) may be connected between the microphone 624 and the loudspeaker 610.

Active noise control is generally best suited for low frequencies, i.e., below about 1 kHz or below about 500 Hz. Passive noise control, on the other hand, is more effective at higher frequencies, i.e., above about 1 kHz or above about 500 Hz. The microphone 624 of the active noise system, may be arranged adjacent to the passive noise system. For example the microphone may be arranged in front of the loudspeaker 610 with insulation wool arranged between the membrane of the loudspeaker 610 and the microphone 624. In another example, the microphone 624 may be enclosed by insulation wool of the passive noise control system 642. These, however, are only examples. Any other suitable implementations are possible.

The loudspeaker system of FIG. 6, therefore, provides an effective solution for dynamic problems as well as noise problems in externally coupled loudspeakers. Any noise or other disturbances coming from the outside 602 or from the inside 601, i.e., distortion of the loudspeaker 610, as well as other disturbances such as pressure changes which alter the point of operation, for example, may be counteracted with the loudspeaker system.

Figure 7:
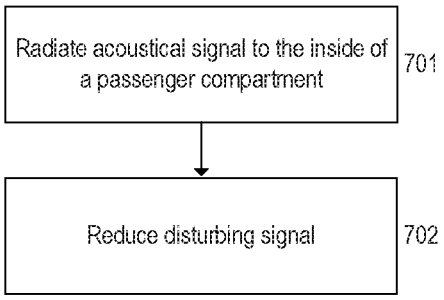
FIG. 7 is a flow diagram illustrating a noise reducing sound reproduction method.

FIG. 7 is a flow diagram illustrating a noise reducing sound reproduction method. In this method an acoustical signal is radiated to the inside of a passenger compartment by a loudspeaker that is arranged in a baffle between a passenger compartment of a vehicle and the outside of the passenger compartment (step 701). Further, a disturbing signal in the passenger compartment is reduced by an active noise control system comprising a microphone that is acoustically coupled to the loudspeaker via a secondary path (step 702).

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A loudspeaker system comprising:

a loudspeaker that is arranged in a baffle between a passenger compartment of a vehicle and an outside of the passenger compartment, wherein the loudspeaker is configured to radiate an acoustical signal to the passenger compartment;

a passive noise reduction system configured to eliminate high frequency noise; and an active noise control system, wherein:

a microphone is acoustically coupled to the loudspeaker via a secondary path, the loudspeaker is electrically coupled to the microphone via an active noise control filter, the loudspeaker comprises a first side and a second side and wherein the first side faces the passenger compartment of the vehicle and the second side faces an outside of the vehicle, and the microphone is arranged at the first side of the loudspeaker and adjacent to the passive noise reduction system.

2. The loudspeaker system of claim 1, wherein the loudspeaker is connected to a loudspeaker input path;

the microphone is connected to a microphone output path;

a subtractor is connected downstream of the microphone output path and a first useful-signal path;

the active noise control filter is connected downstream of the subtractor;

an adder is connected between the active noise control filter and the loudspeaker input path and to a second useful-signal path; and both of the first and second useful-signal paths are supplied with a useful signal to be reproduced.

3. The loudspeaker system of claim 2, wherein at least one of the first and second useful-signal paths comprises one or more spectrum shaping filters.

4. The loudspeaker system of claim 2, wherein the active noise control filter is configured to eliminate low frequency noise.

5. The loudspeaker system of claim 1, wherein the active noise control filter is configured to eliminate noise at frequencies below 1 kHz and the passive noise reduction system is configured to eliminate noise at frequencies above 1 kHz.

6. The loudspeaker system of claim 1, wherein the active noise control filter is configured to eliminate noise at frequencies below 500 Hz and the passive noise reduction system is configured to eliminate noise at frequencies above 500 Hz.

7. The loudspeaker system of claim 1, wherein the passive noise reduction system comprises at least one layer of insulation wool.

8. The loudspeaker system of claim 7, wherein the microphone is enclosed by the at least one layer of insulation wool of the passive noise reduction system.

9. The loudspeaker system of claim 7, wherein the at least one layer of insulation wool is arranged adjacent to a membrane of the loudspeaker and wherein:

the membrane is arranged between the passenger compartment and the layer of insulation wool, the layer of insulation wool is arranged between the passenger compartment and the membrane, or the membrane is arranged between two layers of insulation wool.

10. The loudspeaker system of claim 1, wherein the baffle comprises an opening in which the loudspeaker is disposed.

11. A method for noise reducing sound reproduction comprising:

radiating an acoustical signal to an inside of a passenger compartment of a vehicle with a loudspeaker that is arranged in a baffle between the passenger compartment and an outside of the passenger compartment;

reducing a disturbing signal with an active noise control system comprising a microphone that is acoustically coupled to the loudspeaker via a secondary path, wherein the loudspeaker is electrically coupled to the microphone via an active noise control filter; and eliminating high frequency noise via a passive noise reduction system, wherein:

the loudspeaker comprises a first side and a second side and wherein the first side faces the passenger compartment of the vehicle and the second side faces an outside of the vehicle, and the microphone is arranged at the first side of the loudspeaker and adjacent to the passive noise reduction system.

12. The method of claim 11 further comprising:

supplying a loudspeaker input signal to the loudspeaker;

receiving the acoustical signal radiated by the loudspeaker to provide a microphone output signal;

subtracting the microphone output signal from a useful-signal to generate a filter input signal;

filtering the filter input signal in an active noise control filter to generate an error signal; and adding the useful-signal to the error signal to generate the loudspeaker input signal.

13. A loudspeaker system comprising:

a loudspeaker arranged in a baffle and positioned between a passenger compartment of a vehicle and an outside of the passenger compartment, wherein the loudspeaker is configured to radiate an acoustical signal to the passenger compartment;

a passive noise reduction system configured to eliminate high frequency noise; and an active noise control system including a microphone that is acoustically coupled to the loudspeaker via a secondary path and being configured to reduce a disturbing signal in the passenger compartment, wherein the loudspeaker is electrically coupled to the microphone via an active noise control filter, wherein the loudspeaker comprises a first side and a second side, wherein the first side faces the passenger compartment of the vehicle and the second side faces an outside of the vehicle, and wherein the microphone is arranged at the first side of the loudspeaker and adjacent to the passive noise reduction system.

14. The loudspeaker system of claim 13, wherein the loudspeaker is connected to a loudspeaker input path;

the microphone is connected to a microphone output path;

a subtractor is connected downstream of the microphone output path and a first useful-signal path;

the active noise control filter is connected downstream of the subtractor;

an adder is connected between the active noise control filter and the loudspeaker input path and to a second useful-signal path; and both of the first and second useful-signal paths are supplied with a useful signal to be reproduced.

15. The loudspeaker system of claim 14, wherein at least one of the first and second useful-signal paths comprises one or more spectrum shaping filters.

16. The loudspeaker system of claim 14, wherein the active noise control filter is configured to eliminate low frequency noise.

* * * * *